US009720362B2

(12) United States Patent
Minamishima et al.

(10) Patent No.: US 9,720,362 B2
(45) Date of Patent: Aug. 1, 2017

(54) HEATING DEVICE AND IMAGE FORMING APPARATUS

(71) Applicant: CANON KABUSHIKI KAISHA, Tokyo (JP)

(72) Inventors: Yasuhito Minamishima, Odawara (JP); Satoshi Nishida, Numazu (JP); Isamu Takeda, Machida (JP); Takanori Mitani, Meridian, ID (US); Kazuhiro Doda, Yokohama (JP); Hideo Nanataki, Yokohama (JP); Akimichi Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/160,435

(22) Filed: May 20, 2016

(65) Prior Publication Data

US 2016/0342117 A1 Nov. 24, 2016

(30) Foreign Application Priority Data

May 22, 2015 (JP) ..... 2015-104267

(51) Int. Cl.
*G03G 15/20* (2006.01)

(52) U.S. Cl.
CPC . *G03G 15/2057* (2013.01); *G03G 2215/2019* (2013.01); *G03G 2215/2035* (2013.01)

(58) Field of Classification Search
CPC ..... G03G 15/205; G03G 15/2089; G03G 15/2064; G03G 15/2053; G03G 15/2057
See application file for complete search history.

(56) References Cited

U.S. PATENT DOCUMENTS

| | | | | |
|---|---|---|---|---|
| 7,206,541 | B2 | 4/2007 | Fukita et al. | |
| 7,518,089 | B2 | 4/2009 | Hashiguchi et al. | |
| 7,519,320 | B2 | 4/2009 | Aoki et al. | |
| 7,650,105 | B2 | 1/2010 | Ogawa et al. | |
| 8,285,183 | B2 | 10/2012 | Nishida et al. | |
| 8,385,802 | B2 * | 2/2013 | Okabe | G03G 15/2064 399/329 |
| 8,417,169 | B2 * | 4/2013 | Hasegawa | G03G 15/2053 399/329 |
| 8,483,603 | B2 | 7/2013 | Nihonyanagi et al. | |

(Continued)

FOREIGN PATENT DOCUMENTS

| | | |
|---|---|---|
| JP | 2000029334 A | 1/2000 |
| JP | 2002236425 A | 8/2002 |

(Continued)

*Primary Examiner* — Gregory H Curran
(74) *Attorney, Agent, or Firm* — Fitzpatrick, Cella, Harper & Scinto

(57) ABSTRACT

An image forming apparatus for forming a toner image on a recording material, the apparatus includes a cylindrical film; a plate-like nip forming member contacted with an inner surface of the film, the nip forming member including a base member and a coating layer on the base member, the coating layer having a thermal expansion coefficient smaller than that of the base member; and a roller cooperative with the nip forming member to form a nip, wherein the coating layer is provided on a first surface of the nip forming member which is opposed to the film and on a second surface opposite from the first surface except for an outer edge portion of the nip forming member.

8 Claims, 9 Drawing Sheets

(a)

(b)

(56) References Cited

U.S. PATENT DOCUMENTS

| | | | | |
|---|---|---|---|---|
| 8,532,530 | B2 | 9/2013 | Nishida et al. | |
| 8,811,872 | B2 | 8/2014 | Nakagawa et al. | |
| 8,831,493 | B2 | 9/2014 | Tanaka et al. | |
| 8,891,989 | B2 | 11/2014 | Umeda et al. | |
| 9,014,608 | B2 | 4/2015 | Okayasu et al. | |
| 9,213,276 | B2 | 12/2015 | Mitani et al. | |
| 9,229,388 | B2 | 1/2016 | Imaizumi et al. | |
| 9,335,688 | B2 | 5/2016 | Mitani et al. | |
| 2006/0056891 | A1 | 3/2006 | Hashiguchi et al. | |
| 2014/0023413 | A1 | 1/2014 | Shinji et al. | |
| 2015/0125193 | A1* | 5/2015 | Ishii ..... | G03G 15/2042 399/329 |
| 2015/0227091 | A1 | 8/2015 | Ando et al. | |
| 2016/0033908 | A1 | 2/2016 | Tsunashima et al. | |
| 2016/0062281 | A1 | 3/2016 | Minamishima et al. | |
| 2016/0085191 | A1 | 3/2016 | Imaizumi et al. | |

FOREIGN PATENT DOCUMENTS

| | | | |
|---|---|---|---|
| JP | 2006084821 | A | 3/2006 |
| JP | 2014038311 | A | 2/2014 |

* cited by examiner (a)

(b)

(a)

(b)

(a)

| MATERIAL | T. EXP. COEFFICIENT [ $1\times10^{-6}$/K] |
|---|---|
| ALUMITE TREATED FILM | 4．5 |
| PURE Al | 24 |

(b)

| | NO. OF OCCURRENCES OF IMPROPER FEEDING (5000 SHEETS) | |
|---|---|---|
| | WITHOUT T. IMAGE | WITH T. IMAGE |
| EMB. 1 | 0 | 0 |
| COMP. EX. | 0 | 3 |

Fig. 7

| MATERIAL | T. EXP. COEFFICIENT [ $1\times10^{-6}$/K] |
|---|---|
| GLASS | 9 |
| CUPPER | １６．６ |

HEATING DEVICE AND IMAGE FORMING APPARATUS

FIELD OF THE INVENTION AND RELATED ART

The present invention relates to a heating device to be mounted in an image forming apparatus such as an electrophotographic printer, an electrophotographic copying machine, and the like.

A fixing device of the so-called external heating type has been known as a heating device to be mounted in an electrophotographic printer, an electrophotographic copying machine, and the like. Some fixing devices of the so-called external heating type have: a fixation roller which heats a sheet of recording medium and an image thereon by being placed in contact with the sheet; a pressure application film which is in the form of a cylindrical belt; and a nip forming component which forms a fixation nip between itself and the fixation roller, by being in contact with the inward surface of this cylindrical pressure application film. A sheet of recording medium on which an unfixed toner image is borne is conveyed through the fixation nip, remaining pinched between the fixation roller and pressure application film. While the sheet is conveyed through the fixation nip, the sheet and the unfixed toner image thereon are heated, whereby the unfixed toner image becomes fixed to the sheet.

A fixing device such as the above-described one is sometimes required to continuously process a substantial number of small sheets of recording medium at a high speed. In such a case, it occurs sometimes that areas of fixation roller and areas of pressure application film, which are outside the path of a sheet of recording medium (out-of-sheet-path areas), increase in temperature high enough to suffer from thermal damages.

On the other hand, if the nip forming component is not provided with a friction reducing layer, the friction between the nip forming component and pressure application film may be large enough to cause the surface of the nip forming component and the surface of the pressure application film to frictionally shave each other to yield tiny abrasive particles by an amount large enough to further increase the friction between the nip forming component and pressure film, increase the amount of torque necessary to drive the fixation roller, and/or cause the fixing device to generate noises attributable to the so-called slip-and-stick phenomenon.

By the way, the slip-and-stick phenomenon refers to a phenomenon that as the friction between two surfaces which are in contact with each other fails to linearly reduces when the friction between the two surfaces changes in state from being static to dynamic, or in the like situation, noises occur between two surfaces as the amount of friction between the two surfaces noncontinuously changes because of the change in the amount of difference in speed between the two surfaces.

In the case of the fixing device disclosed in Patent document 1, aluminum is used as the material for the substrate of its nip forming component. Further, the surface of the substrate which faces the inward surface of the pressure film is oxidized (anodized) to form a layer of Alumite. Since aluminum, which is high in thermal conductivity, is used as the material for the substrate of the nip forming component, the nip forming component is highly effective to transfer heat from its out-of-sheet-path areas to its sheet path area, being therefore highly effective to keep itself uniform in temperature (amount of heat) in terms of its lengthwise direction. Further, because the surface of the nip forming component, which faces the inward surface of the pressure film, that is, the surface on which the pressure film slides, is covered with the layer of Alumite (aluminum oxide), it is ensured that the pressure film smoothly slides on the nip forming component.

However, in the case of a fixing device having a nip forming component, such as the one disclosed in Japanese Laid-open Patent Application No. 2014-38311, which presses a sheet of recording medium from the opposite surface of the sheet from the surface of the sheet on which a toner image is present, suffers from the following problem. That is, aluminum which is the material for the substrate of the nip forming component is different in the amount of thermal expansion from the layer of aluminum oxide formed on the aluminum substrate, as the layer on which the pressure film slides. Thus, as the nip forming component is heated, it deforms, causing sometimes a sheet of recording medium to wrap around a rotational component (fixation roller).

The nip forming component is flat across. It forms a fixation nip by being pressed against a fixation roller with the placement of the pressure film between itself and fixation roller. The unfixed toner image formed on a sheet of recording medium is thermally fixed to the sheet by being heated by being placed in contact with the heated fixation roller while being pressed upon the fixation roller by the nip forming component.

As a fixing device is continuously used to output a substantial number of images (prints), its components, including the nip forming component, which are on the inward side of its pressure film, become high in temperature. As a result, the nip forming component expands (thermal expansion). However, the substrate which is formed of aluminum is smaller in coefficient of thermal expansion than the layer (film) of aluminum oxide, on which the pressure film slides. Therefore, the nip forming component warps in such a manner that the layer on which the pressure film slides concaves downward with reference to the direction parallel to the recording medium conveyance direction.

As the surface of the nip forming component, on which the pressure film slides, concaves, the fixation nip changes in shape so that it conforms to the curvature of the fixation roller which comes into contact with a toner image. Thus, it is likely for the toner image on a sheet of recording medium to be allowed to remain adhered to the fixation roller longer than desired, as it comes out of the fixation nip. Therefore, it is likely for the sheet to sometimes wrap around the fixation roller.

SUMMARY OF THE INVENTION

According to an aspect of the present invention, there is provided an image forming apparatus for forming a toner image on a recording material, said apparatus comprising a cylindrical film; a plate-like nip forming member contacted with an inner surface of said film, said nip forming member including a base member and a coating layer on said base member, said coating layer having a thermal expansion coefficient smaller than that of said base member; and a roller cooperative with said nip forming member to form a nip, wherein said coating layer is provided on a first surface of said nip forming member which is opposed to said film and on a second surface opposite from said first surface except for an outer edge portion of said nip forming member.

According to another aspect of the present invention, there is provided an image forming apparatus for forming a toner image on a recording material, said apparatus comprising a cylindrical film; a plate-like nip forming member contacted with an inner surface of said film, said nip forming member including a base member of aluminum and an oxide coating layer on said base member; and a roller cooperative with said nip forming member to form a nip, wherein said oxide coating layer is provided on a first surface opposed to said film and on a second surface opposite from said first surface except for an outer edge portion of said nip forming member.

Further features of the present invention will become apparent from the following description of exemplary embodiments with reference to the attached drawings.

Figure 4:
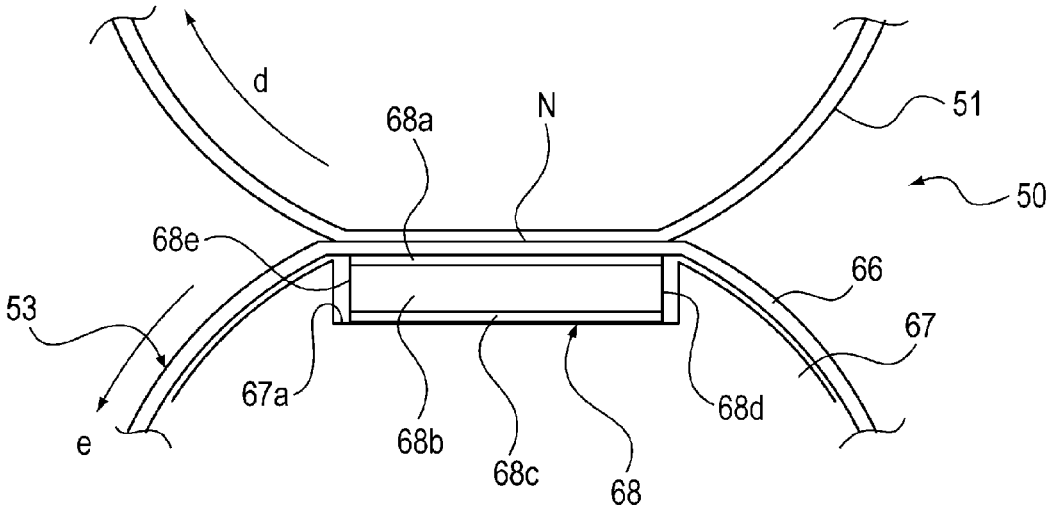
Figure 4:
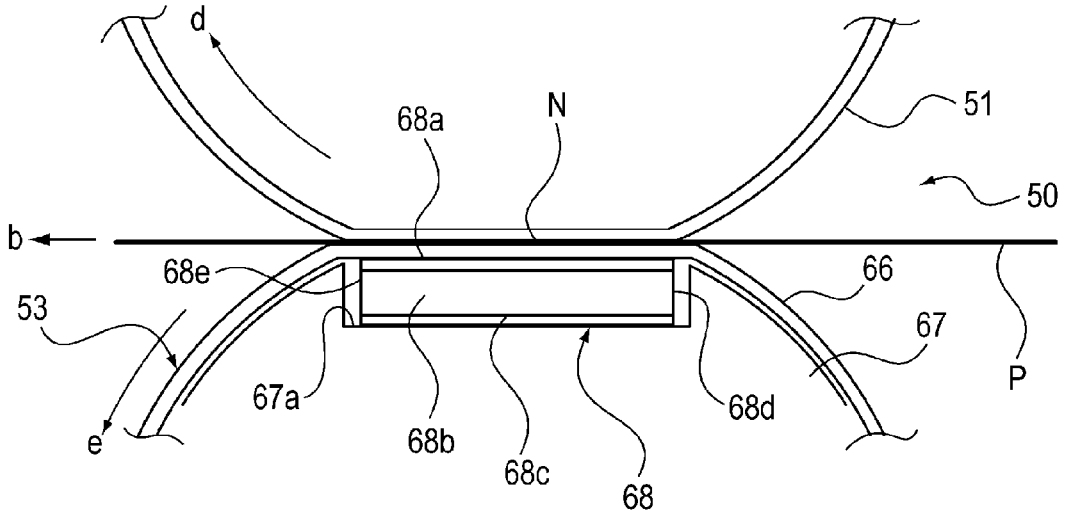

Part (a) of FIG. 4 is a sectional view of the fixation nip, and its adjacencies, of the fixing device in the first embodiment, while a sheet of recording medium is not conveyed through the nip, for fixation. It shows the structure of the device. Part (b) of FIG. 4 is a sectional view of the fixation nip, and its adjacencies, of the fixing device in the first embodiment, while a sheet of recording medium is conveyed through the nip, for fixation. It also shows the structure of the device.

Figure 5:
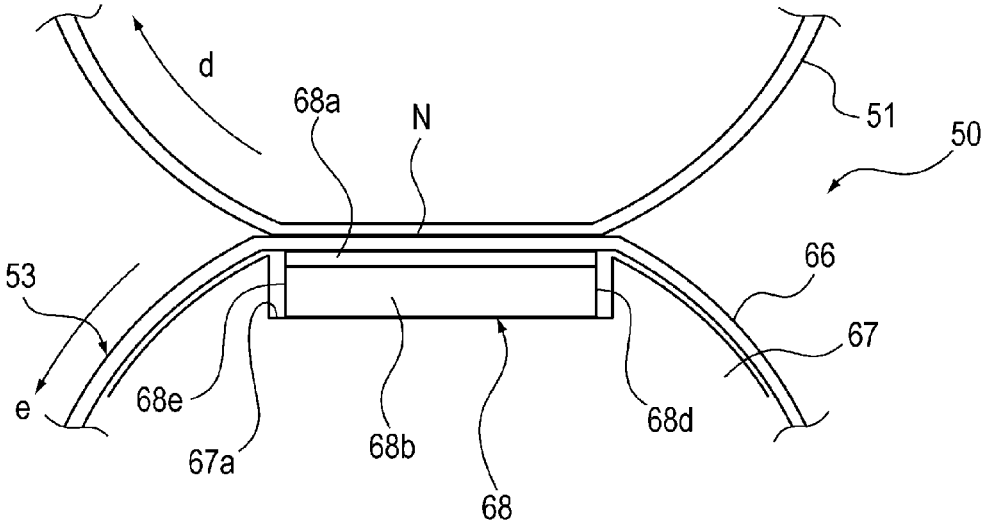
Figure 5:
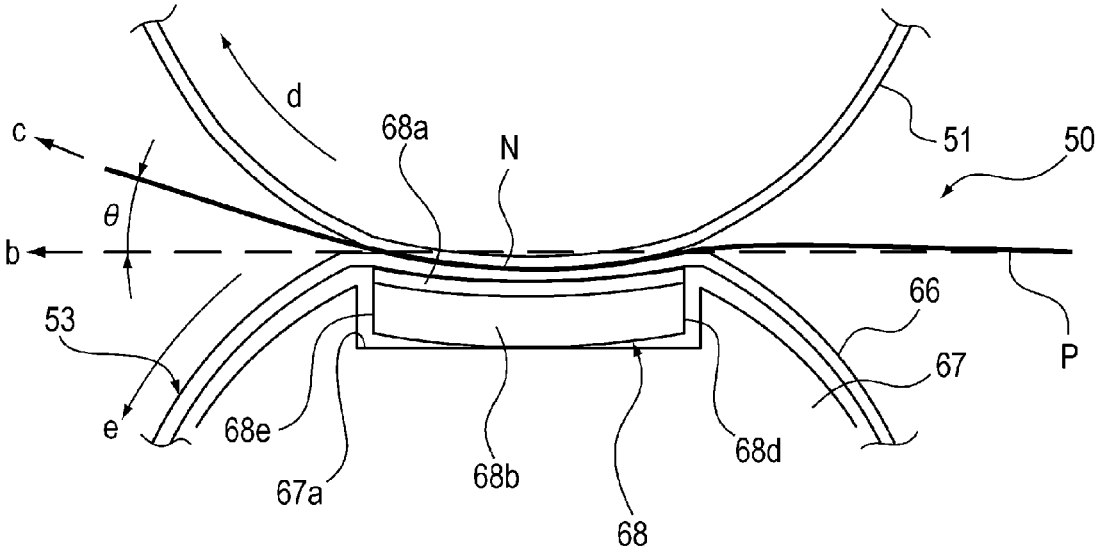

Part (a) of FIG. 5 is a sectional view of the fixation nip, and its adjacencies, of a comparative fixing device, while a sheet of recording medium is not conveyed through the nip, for fixation. It shows the structure of the device. Part (b) of FIG. 5 is a sectional view of the fixation nip, and its adjacencies, of the comparative fixing device, while a sheet of recording medium is conveyed through the nip, for the thermal fixation of the toner image on the sheet.

Figure 6:
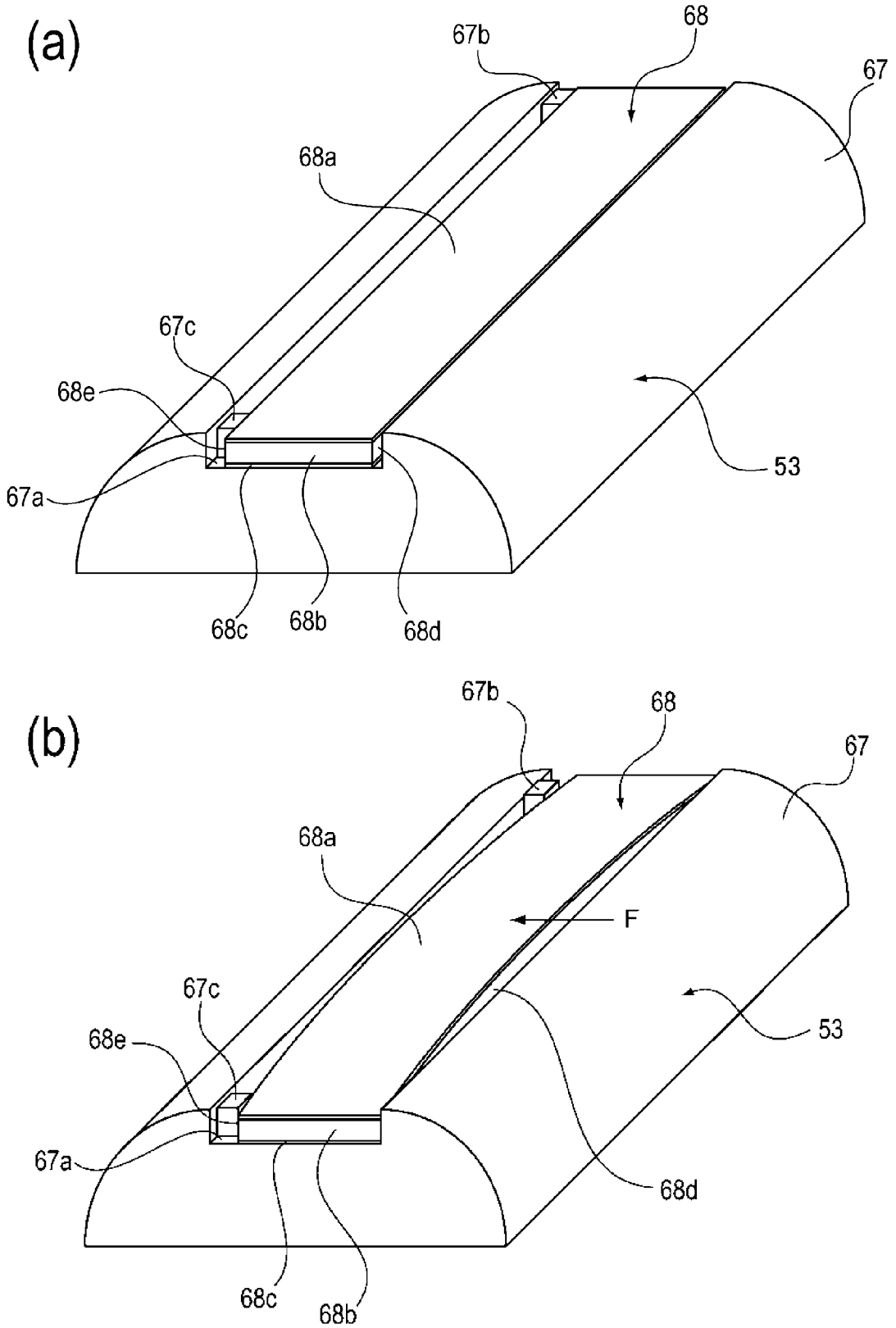

Part (a) of FIG. 6 is a perspective view of the nip forming component of the fixing device in the first embodiment, and shows the structure of the component. Part (b) of FIG. 6 is a perspective view of the nip forming component of the fixing device in the first embodiment, while the nip forming component is being deformed by the force to which the nip forming component is subjected as the inward surface of the rotating endless belt slides on the nip forming component.

Part (a) of FIG. 7 is a table which shows the coefficient of thermal expansion of aluminum oxide, and that of pure aluminum. Part (b) of FIG. 7 is a table which shows the number of times a sheet of recording medium failed to be properly conveyed out of the fixing device (number of times sheet wrapped around fixation roller) when 5000 sheets of recording medium, on each of which a toner image was present, were conveyed through the fixing device in the first embodiment, when 5000 sheets of recording medium, on each of which no toner image was present, were conveyed through the fixing device in the first embodiment, when 5000 sheets of recording medium, on each of which a toner image was present, were conveyed through the comparative fixing device, and when 5000 sheets of recording medium, on each of which no toner image was present, were conveyed through the comparative fixing device.

Figures 8, 9:
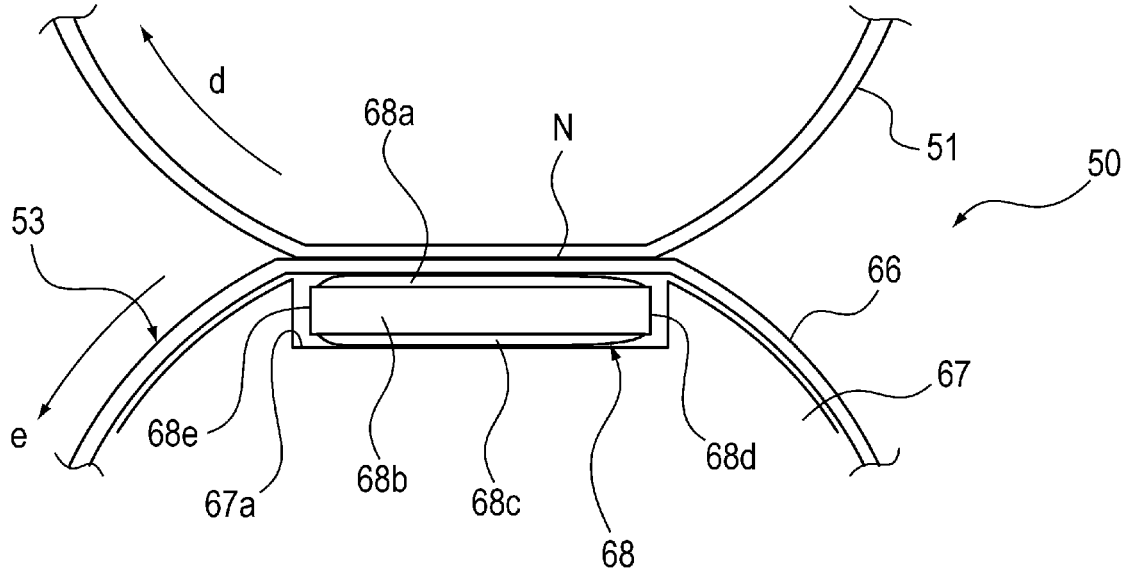

FIG. 8 is a sectional view of the fixation nip, and its adjacencies, of the fixing device in the second embodiment of the present invention, and shows the structure of the device.

FIG. 9 is a table which shows the coefficient of thermal expansion of glass, and that of copper.

Figure 10:
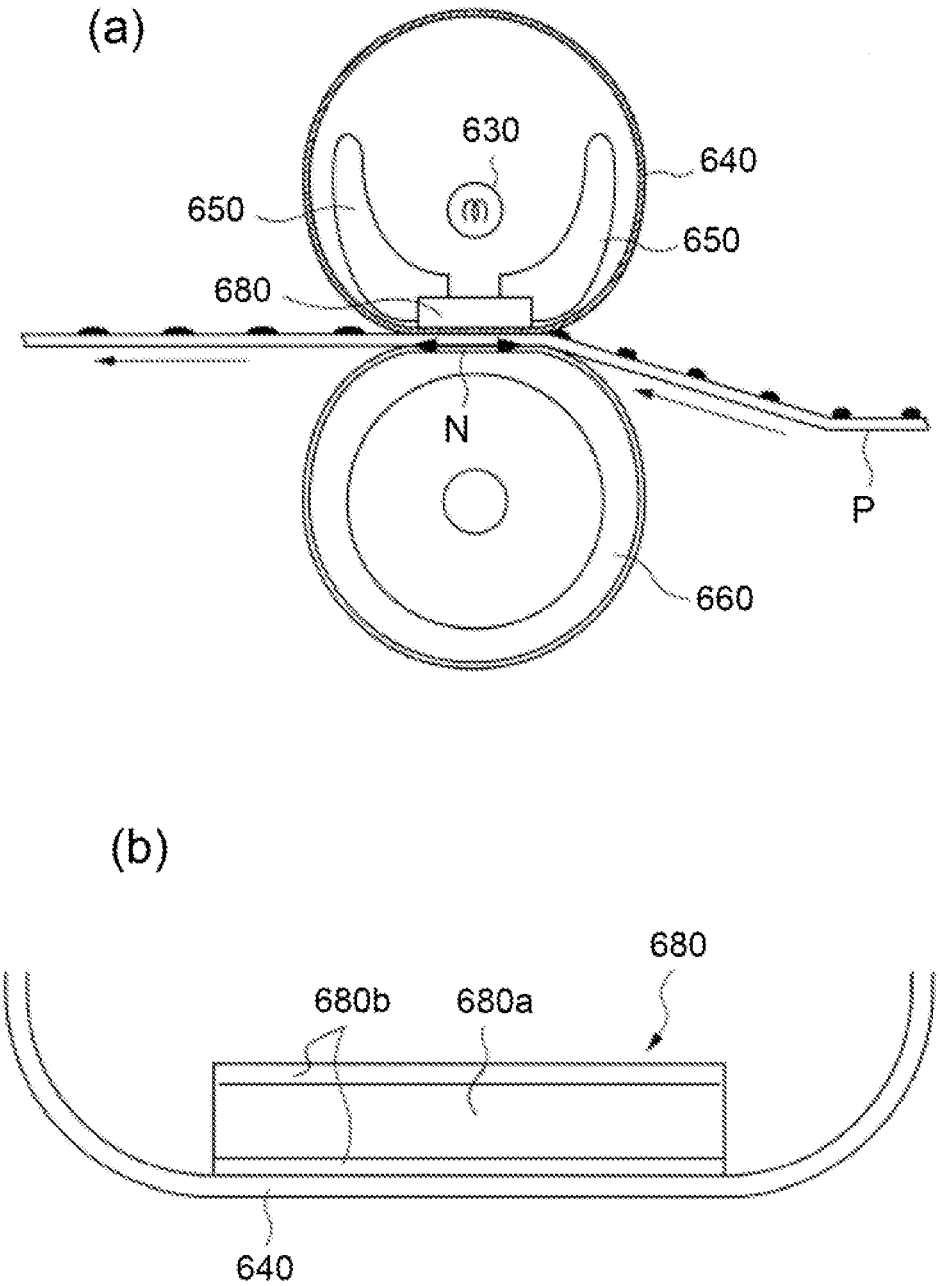

Part (a) of FIG. 10 is a sectional view of the fixing device in the third embodiment of the present invention, and shows the structure of the device. Part (b) of FIG. 10 is an enlarged sectional view of the nip forming component, in the third embodiment, which contacts the film. It shows the structure of the nip forming component.

DESCRIPTION OF THE EMBODIMENTS

Hereinafter, some of preferred embodiments of the present invention are concretely described with reference to image forming apparatuses equipped with a heating device which is in accordance with the present invention.

Embodiment 1

To begin with, referring to FIGS. 1-7, the image forming apparatus, in the first embodiment of the present invention, equipped with a heating device, as a fixing device, which is in accordance with the present invention, is described about its structure.

<Image Forming Apparatus>

Figure 1:
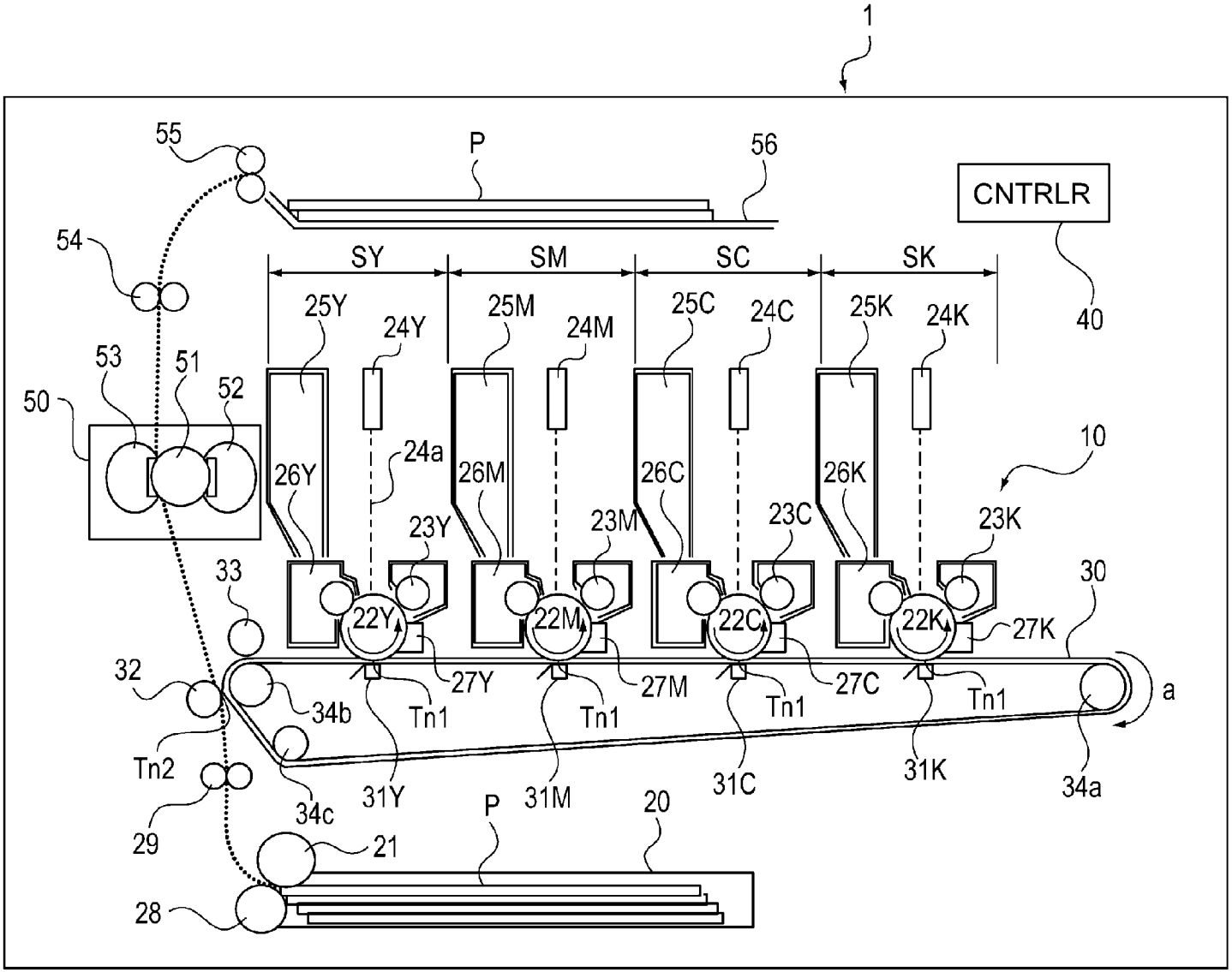
FIG. 1 is a sectional view of a typical image forming apparatus which is equipped with a fixing device which is in accordance with the present invention. It shows the general structure of the apparatus.

FIG. 1 is a sectional view of an image forming apparatus equipped with a heating device, as a fixing device, which is in accordance with the present invention. It shows the structure of the apparatus. The image forming apparatus 1 shown in FIG. 1 is an example of full-color laser printer of the so-called inline type.

The image forming apparatus 1 in this embodiment has: an image forming section 10, which is an image forming means for forming an unfixed toner image t on the surface of a sheet P of recording medium; and a fixing device 50, as a heating device, which thermally fixes the unfixed toner image t formed on the surface of the sheet P.

The image forming section 10 has four image forming sections SY, SM, SC and SK, which are aligned upstream to downstream in the listed order in terms of the direction, indicated by an arrow mark a in FIG. 1, in which an intermediary transfer belt 30, as an intermediary transferring component, is rotationally moved. In the image forming sections SY, SM, SC and SK, listing from the upstream side, yellow (Y), magenta (M), cyan (C) and black (K) toner images are formed, respectively. The four image forming sections SY, SM, SC and SK are the same in image formation process. Therefore, each of the image forming sections SY, SM, SC and SK may be referred to simply as an image forming section S, for convenience sake.

Referential codes 22Y, 22M, 22C and 22K in FIG. 1 stand for photosensitive drums, as image bearing components, in the image forming sections SY, SM, SC and SK, respectively. As the rotational driving force of an unshown driving motor, as a driving force source, is transmitted to each photosensitive drum 22, the photosensitive drum 22 rotates in the counterclockwise direction in FIG. 1.

Each image forming section S (SY, SM, SC and SK) is provided with: a charge roller 23 (23Y, 23M, 23C and 23K) which is a charging means; a laser scanner 24 (24Y, 24M, 24C and 24K) which is an exposing means; a developing device 26 (26Y, 26M, 26C and 26K) which is a developing means; and a primary transferring device 31 (31Y, 31M, 31C and 31K) which is the primary transferring means; a cleaning device 27 (27Y, 27M, 27C and 27K) which is a cleaning means; etc. The charge roller 23, laser scanner 24, developing device 26, primary transferring device 31, and cleaning device 27, etc., are disposed in the adjacencies of the photosensitive drum 22, in the listed order in terms of the rotational direction of the photosensitive drum 22.

Further, there is disposed above the developing device 26, a toner cartridge 25 (25Y, 25M, 25C and 25K) for supplying the developing device 26 with toner (yellow, magenta, cyan and black toners).

The intermediary transfer belt 30 is an endless belt formed of a resinous substance. It is rotatably suspended and kept tensioned by three rotatable belt supporting components, more specifically, a driver roller 34*a*, a belt-backing roller 34*b* (which opposes secondary transfer roller), and a tension roller 34*c*.

The outward surface of the intermediary transfer belt 30 is placed in contact with the peripheral surface of the photosensitive drum 22, forming thereby the primary transfer nip Tn1 between the two surfaces. To the driver roller 34*a*, which is one of the three rollers by which the intermediary transfer belt 30 is suspended and kept tensioned, the rotational driving force of an unshown belt driving motor as a belt driving force source is applied. Thus, the driver roller 34*a* rotates in the direction indicated by an arrow mark a in FIG. 1.

The secondary transfer roller 32, which is the secondary transferring means, is disposed so that it opposes the belt-backing roller 34*b*, with the presence of the intermediary transfer belt 30 between itself and the belt-backing roller 34*b*. The peripheral surface of the secondary transfer roller 32 is placed in contact with the outward surface of the intermediary transfer belt 30, forming thereby the secondary transfer nip Tn2.

A controlling section 40, which is a controlling means, has a CPU (Central Processing Unit). It has also memories such as a RAM (Random Access Memory), a ROM (Read Only Memory), etc., which are storing means.

Software (programs), such as a control sequence, for the controlling section 40 to make the image forming apparatus 1 to carry out an image forming operation are stored in the memories. The controlling section 40 controls the image forming section 10, fixing device 50, etc., in operation, by carrying out the control sequences for making the image forming apparatus 1 to carry out an image forming operation, in response to a print command outputted from an unshown external device such as a host computer or the like.

As the controlling section 40 starts carrying out the control sequence for making the image forming apparatus 1 to carry out an image forming operation, the photosensitive drum 22Y begins to be rotationally driven in the counterclockwise direction in FIG. 1, in the image forming section SY, shown in FIG. 1, in the image forming apparatus 1 in this embodiment.

As the photosensitive drum 22Y is rotationally driven in the counterclockwise direction in FIG. 1, the peripheral surface of the photosensitive drum 22Y is uniformly charged (charging process) to preset polarity and potential level by the charge roller 23Y to which charge bias voltage is being applied. The laser scanner 24Y projects a beam 24*a* of laser light upon the uniformly charged peripheral surface of the photosensitive drum 22Y, while modulating the beam 24*a* according to the image data inputted from the external device. Consequently, an electrostatic latent image is formed on the peripheral surface of the photosensitive drum 22Y (exposing process).

The developing device 26Y develops the electrostatic latent image formed on the peripheral surface of the photosensitive drum 22Y, into a visible image, that is, an image formed of toner (which hereafter may be referred to simply as toner image), by supplying the electrostatic latent image with yellow (Y) toner. That is, a yellow toner image is formed on the peripheral surface of the photosensitive drum 22Y.

Processes which are similar to the above-described image formation processes (charging process, exposing process, developing process, etc.,) carried out in the image forming station SY are carried out also in each of the image forming sections SM, SC and SK. Consequently, magenta (M), cyan (C) and black (K) toner images are formed on the peripheral surface of the photosensitive drum 22M, peripheral surface of the photosensitive drum 22C, and peripheral surface of the photosensitive drum 22K, respectively.

The yellow (Y) toner image formed on the peripheral surface of the photosensitive drum 22Y is transferred onto the outward surface of the intermediary transfer belt 30 by the primary transfer bias voltage which is applied to the primary transferring device 31Y, in the primary transfer nip Tn1 (primary transfer process). Similarly, the magenta (M), cyan (C) and black (K) toner images formed on the peripheral surface of the photosensitive drums 22M, 22C and 22K, respectively, are sequentially transferred (primary transfer) in layers onto the outward surface of the intermediary transfer belt 30 by the primary transfer bias voltage applied to the primary transferring devices 31M, 31C and 31K, in the corresponding primary transfer nips Tn1, respectively (primary transfer process). Consequently, an unfixed full-color toner image t (made up of four monochromatic toner images, which are different in color) is effected on the outward surface of the intermediary transfer belt 30.

Transfer residual toner on the photosensitive drums 22Y, 22M, 22C and 22K, that is, the toner remaining on the peripheral surface of the photosensitive drums S after the primary transfer process, is removed by the cleaning devices 27Y, 27M, 27C and 27K, respectively, so that the photosensitive drums 22Y, 22M, 22C and 22K can be used for the formation of next images.

Meanwhile, sheets P of recording medium stored in layers in a feeding-conveying cassette 20 disposed below the intermediary transfer belt 30, are fed one by one into the main assembly of the image forming apparatus 1, by a combination of a feeding-conveying roller 21 and a retard roller 28, from the feeding-conveying cassette 20, while being separated from the rest in the cassette 20. Then, each sheet P is conveyed to a pair of registration rollers 29 which are temporarily remaining stationary. As the leading side of the sheet P comes into contact with the nip between the temporarily stationary pair of registration rollers 29, the sheet P becomes corrected in attitude, because of the resiliency of the sheet P. That is, if a given sheet P of recording medium is sent askew to the nip of the pair of registration rollers 29, it is corrected in attitude so that the leading edge of the sheet P becomes perpendicular to the moving direction of the intermediary transfer belt 30.

The registration rollers 29 is rotationally driven with preset timing, and send a sheet P of recording medium to the secondary transfer nip Tn2 by conveying the sheet P while keeping the sheet P pinched between them. Then, the sheet P is conveyed through the secondary transfer nip Tn2, while remaining pinched by the intermediary transfer belt 30 and secondary transfer roller 32. While the sheet P is conveyed through the secondary transfer nip Tn2, secondary transfer bias is applied to the secondary transfer roller 32, whereby the unfixed toner images t on the outward surface of the intermediary transfer belt 30 is transferred (secondary transfer) onto the sheet P (secondary transfer process).

After the transfer of the unfixed toner images t onto a sheet P of recording medium, the sheet P is introduced into the fixing device 50, and is conveyed through the fixing device 50. While the sheet P is conveyed through the fixing device 50, the sheet P and the toner images thereon are subjected to heat and pressure, whereby the toner images t are thermally fixed to the surface of the sheet P. After the sheet P is conveyed out of the fixing device 50, it is conveyed further, and is discharged onto a delivery tray 56 by a pair of discharge rollers 54 and 55.

The secondary transfer residual toner, that is, the toner remaining on the outward surface of the intermediary transfer belt 30 after the secondary transfer, is charged by the charge roller 33 to the opposite polarity from the polarity to which toner is charged for image formation. Then, it is electrostatically transferred from the outward surface of the intermediary transfer belt 30, onto the photosensitive drum 22. Then, it is recovered by the cleaning device 27.

<Heating Device>

Figure 2:
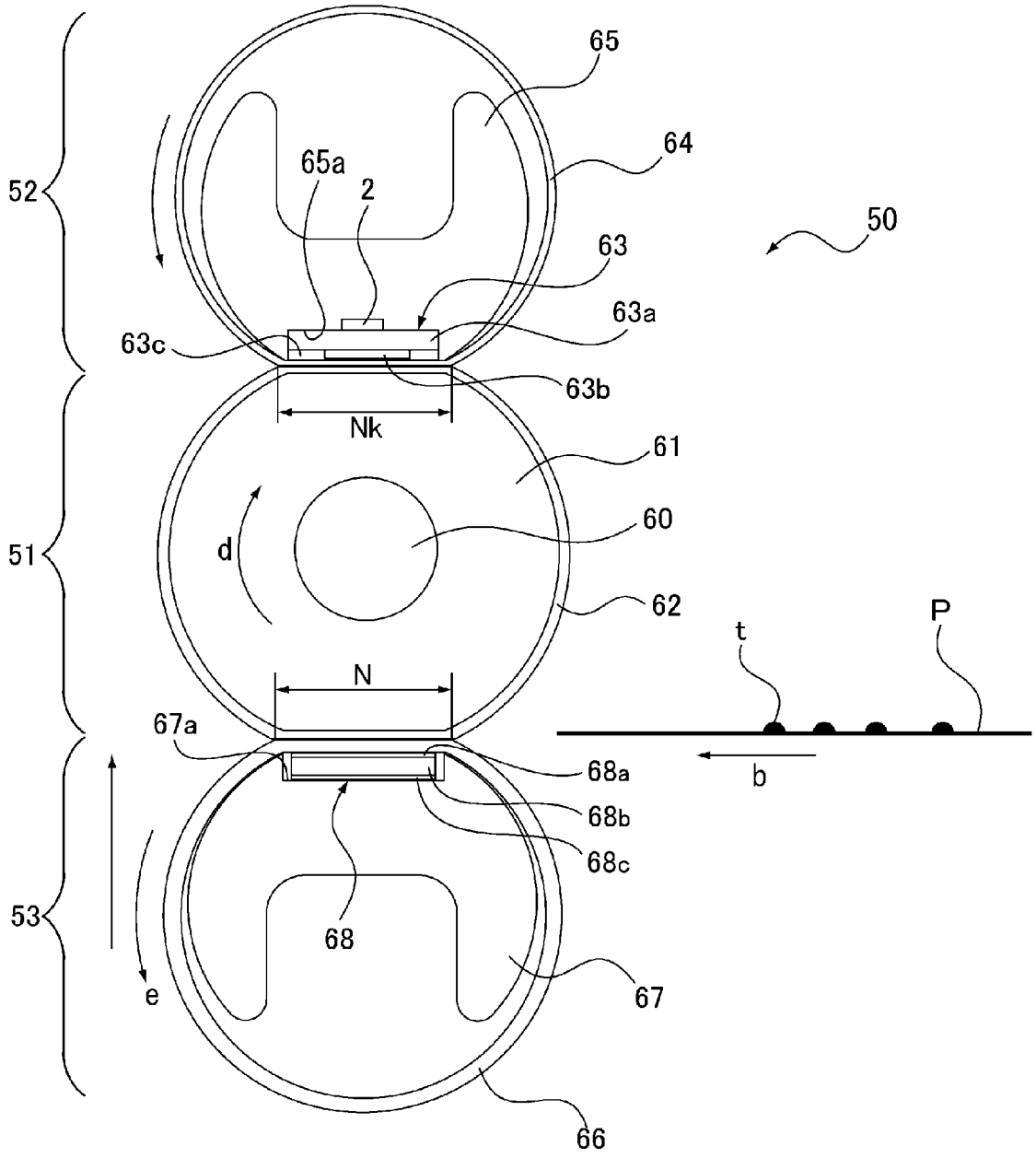
FIG. 2 is a sectional view of the fixing device in the first of the preferred embodiments of the present invention, at a plane perpendicular to the lengthwise direction of the fixing device. It shows the structure of the device.
Figure 3:
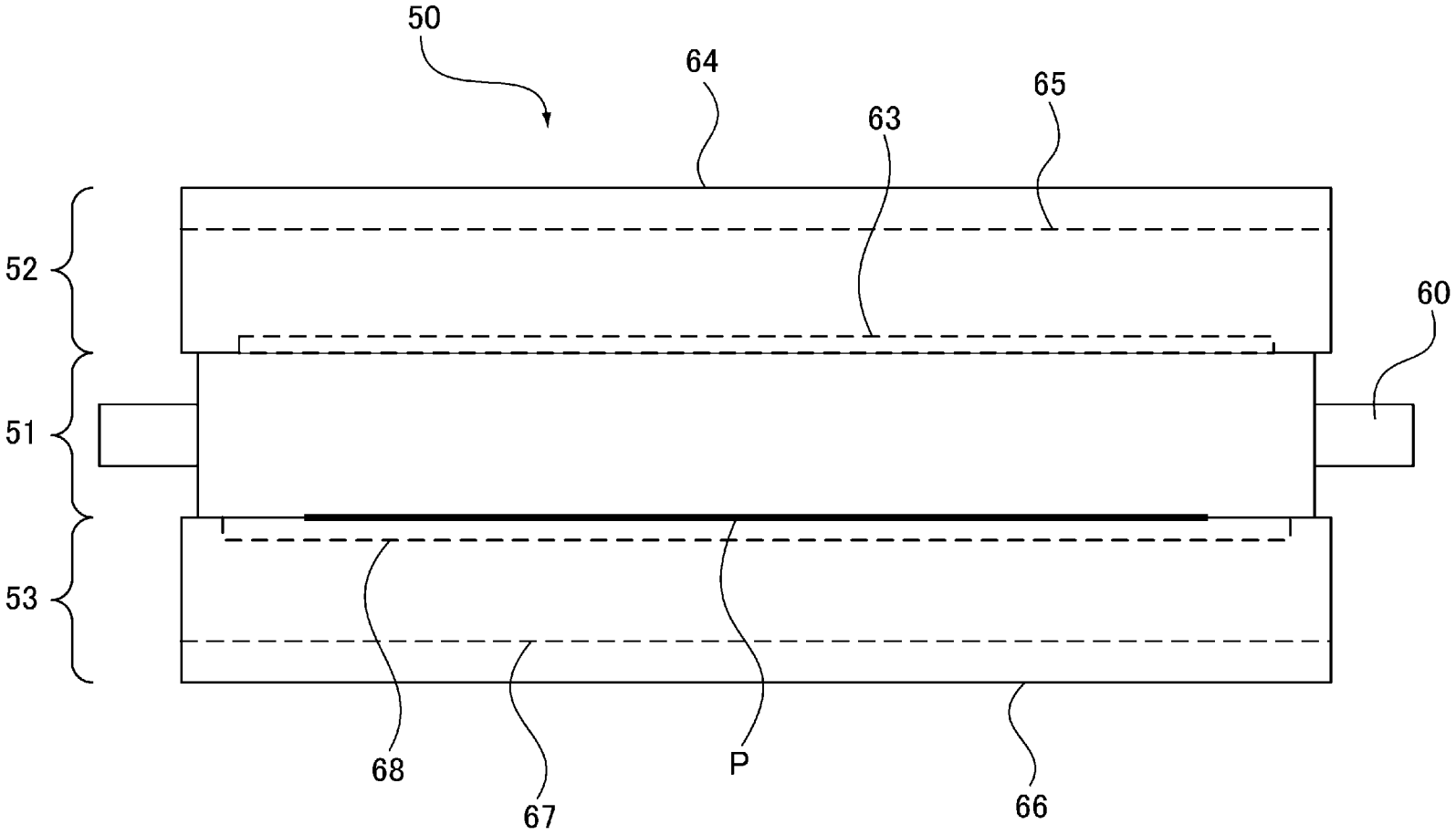
FIG. 3 is a front view of the fixing device in the first embodiment, and shows the structure of the device.

Next, referring to FIGS. 2 and 3, the fixing device 50, which is a heating device, is described about its structure. The fixing device 50 which is a heating device has: a fixation roller 51 which is a rotatable component; and a pressure unit 53 provided with a pressure film 66 which is an endless belt. The fixing device 50 forms a fixation nip N with its fixation roller 51 and pressure film 66. A sheet P of recording medium on which an unfixed toner image t is borne is conveyed through the fixation nip N while being subjected to heat and pressure. Consequently, the unfixed toner image t is thermally fixed to the sheet P.

By the way, regarding the orientation of the fixing device 50 and its structural components, in the following description of this embodiment, the "lengthwise direction" means the direction perpendicular to the recording medium conveyance direction b, which is the direction in which a sheet P of recording medium is conveyance through the fixing device 50. The "widthwise direction" means the direction parallel to the recording medium conveyance direction b. The "length" means the measurement in terms of the lengthwise direction. The "width" means the measurement in terms of the widthwise direction. Further, the widthwise direction of a sheet P of recording medium means the direction which is parallel to the recording medium conveyance direction b. Further, the dimension of a sheet P of recording medium in terms of the widthwise direction of the sheet P is the measurement of the sheet P in terms of the widthwise direction of the sheet P.

FIG. 2 is a sectional view of the fixing device 50 in this embodiment, at a plane which is perpendicular to the direction perpendicular to the fixation roller 51 of the fixing device 50. FIG. 3 is a side view of the fixing device 50, as seen from the recording medium entrance side (right side in FIG. 2) of the fixing device 50. The fixing device 50 shown in FIGS. 2 and 3 is an example of fixing device of the so-called external heating type.

Referring to FIGS. 2 and 3, the fixing device 50 in this embodiment has the fixation roller 51, as a rotatable component, which heats an unfixed toner image t by contacting the toner image t. Further, the fixing device 50 has: a heating unit 52 equipped with a ceramic heater 63 as a heat source; and the pressure unit 53.

<Rotational Component>

The fixation roller 51, which is a rotational component, has a metallic core 60, which is circular in cross-section (shaped like round rod), and is formed of such a metallic substance as iron, stainless steel (SUS), aluminum, or the like. The fixation roller 51 has also an elastic layer 61, which covers the peripheral surface of the metallic core 60. The primary ingredient of the elastic roller 61 is silicone rubber or the like.

Further, the fixation roller 51 has a release layer 62, as the outermost layer of the fixation roller 51, which covers the outward surface of the elastic layer 61. The primary ingredient of the release layer 62 is PTFE (polytetrafluoroethylene), PFA (copolymer of tetrafluoroethylene and perfluoroalkylvinylether), FEP (copolymer of tetrafluoroethylene and hexafluoropropylene), or the like.

Referring to FIG. 3, the fixation roller 51 is such a roller that its length is substantially greater than its diameter. It is disposed in parallel to the lengthwise direction (left-right direction in FIG. 3). It is rotatably supported by the unshown frame of the fixing device 50, by the lengthwise ends (left and right ends) of its metallic core 60.

<Heating Unit>

Referring to 2, the heating unit 52 has: a guiding component 65 as a supporting component; and a ceramic heater 63 fitted in a recess 65*a* with which the bottom section of the guiding component 65 is provided. Further, the heating unit 52 has a heating film 64, which is a cylindrical and rotatable heating belt. The heating film 64 is fitted around the guiding component 65. As it is rotationally moved, it is guided by the guiding component 65 while sliding on the outwardly facing surface of the guiding component 65.

Next, referring to FIG. 3, the ceramic heater 63, heating film 64, and guiding component 65 are long and narrow, and are disposed so that their lengthwise direction becomes parallel to the aforementioned "lengthwise direction (left-right direction)".

The guiding component 65 shown in FIG. 2 which is a sectional view of the guiding component 65 at a plane perpendicular to the lengthwise direction, is formed of a heat resistant resinous substance. Roughly speaking, it is shaped like a trough. Its downwardly facing section is provided with an elongated groove 65*a* (recess), in which the ceramic heater 63 is fitted, being thereby supported by the guiding component 65.

The heating film 64, which is heat resistant and cylindrical, is loosely fitted around the guiding component 65. The heating film 64 comprises: a substrative layer formed of polyimide; and a release layer formed of fluorine resin such as PFA (copolymer of tetrafluoroethylene and perfluoroalkylvinylether), or the like, on the outwardly facing surface of the subsrative layer.

The left and right lengthwise ends (left-right direction in FIG. 3) of the guiding component 65 are movably supported by an unshown frame of the fixing device 50. Further, the guiding component 65 is kept under the pressure generated by unshown compression springs, which are pressure applying means, in the direction (vertical direction) perpendicular to the axial line of the fixation roller 51.

Therefore, the ceramic heater 63 is pressed against the fixation roller 51 with the presence of the heating film 64 between the ceramic heater 63 and fixation roller 51. Thus, the elastic layer 61 is elastically compressed (deformed) toward the axial line of the fixation roller 51, across its entire range in terms of the lengthwise direction of the ceramic heater 63 (left-right direction in FIG. 3). Therefore, a heating-pressing section Nk, which has a preset width in terms of the recording medium conveyance direction b, is formed between the peripheral surface of the fixation roller 51 and the outward surface of the heating film 64.

The ceramic heater 63 has: a ceramic substrative plate 63*a* (substrate 63*a*), which is long and narrow and is roughly parallelepipedic in cross-section. The surface of this substrate 63*a*, which is facing the heating-pressing section Nk, has a heat generating resistor 63*b* formed of Ag/Pd (sliver/palladium) or the like, by screen printing. Further, the surface of the substrate 63*a* is provided with a protective layer 63 formed in a manner to cover the heat generating resistor 63*b*. As electric power is flowed through the heat generating resistor 63*b*, the heat generating resistor 63*b* generates heat.

<Pressure Unit>

The pressure unit 53 has the pressure film 66 which is a cylindrical endless film. The fixation roller 51 is rotationally driven by an unshown driving force source, whereas the pressure film 66 is rotated by the rotation of the fixation roller 51 by being directly pressed upon the peripheral surface of the fixation roller 51 which is a rotational component, or being pressed against the peripheral surface of the fixation roller 51 with the presence of a sheet P of recording medium between itself and the peripheral surface of the fixation roller 51. Further, the pressure unit 53 has a guiding component 67 which is such a component that rotatably supports the pressure film 66. Further, it has a nip forming component 68 supported by the guiding component 67 by being fitted in the groove 67*a* (recess) with which the surface of the guiding component 67, which faces the fixation roller 51 is provided. The nip forming component 68 forms the fixation nip N between the fixation roller 51 and pressure film 66 by being placed in contact with the inward surface of the pressure film 66.

The nip forming component 68, pressure film 66, and guiding component 67 are long and narrow components. They are disposed so that their lengthwise direction becomes parallel to the lengthwise direction (left-right direction in FIG. 3) of the fixing device 50.

The nip forming component 68 is in the form of a rectangular parallelepiped, which is rectangular in cross-section. The guiding component 67 is formed of a heat resistant resinous substance. It is shaped like a trough. It is provided with a groove 67*a* (recess) which extends in its lengthwise direction (left-right direction in FIG. 3). It is disposed so that its groove 67*a* faces upward. There is disposed the nip forming component 68 in the groove 67*a*, being thereby supported by the guiding component 67.

The pressure film 66 is loosely fitted around the guiding component 67. The pressure film 66 comprises a substrate (substrative layer) formed of polyimide resin; and a release layer formed on the outward surface of the substrate, of fluorine resin such as PFA (tetrafluoroethylene-perfluoroalkylvinylether), or the like. The pressure film 66 is disposed so that its substrate is placed in contact with the nip forming component 68.

The lengthwise end portions of the guiding component 67 (left and right ends in FIG. 3) are movably supported by the unshown frame of the fixing device 50. It remains pressed against the fixation roller 51 by unshown compression springs which are pressure applying means, in the direction (left-right direction in FIG. 3) which is perpendicular to the axial line of the fixation roller 51.

Thus, the nip forming component 68 is pressed against the fixation roller 51 with the presence of the pressure film 66 between itself and fixation roller 51, causing the elastic layer 61 to elastically deform across its entire range in terms of the lengthwise direction (left-right direction in FIG. 3). Thus, the fixation nip N is formed between the pressure film 66 and fixation roller 51.

The inward surface of the heating film 64 and the inward surface of the pressure film 66 are coated with fluorinated grease, as lubricant, to reduce the heating film 64 and pressure film 66 in the amount of torque necessary to rotationally move them.

The fixing device 50 in this embodiment begins to be rotationally driven by an unshown motor, as a driving force source, in response to a print start command. More concretely, the rotation of the output shaft of the motor is transmitted to the metallic core 60 of the fixation roller 51 by way of a preset unshown driving force transmission gear train, whereby the fixation roller 51 is rotationally driven in the direction indicated by an arrow mark d in FIG. 2.

The rotational driving force of the fixation roller 51 is transmitted to the heating film 64 by the friction which occurs between the peripheral surface of the fixation roller 51 and the outward surface of the heating film 64, in the heating-pressing nip Nk. Thus, the heating film 64 is rotated by the rotation of the fixation roller 51 in the counterclockwise direction in FIG. 2, while remaining in contact with the protective layer 63*c* of the ceramic heater 63.

Further, the rotational driving force of the fixation roller 51 is transmitted to the pressure film 66 by the friction which occurs between the peripheral surface of the fixation roller 51 and the outward surface of the pressure film 66, in the fixation nip N. Thus, the pressure film 66 is rotated in the direction indicated by an arrow mark e in FIG. 2, by the rotation of the fixation roller 51 while remaining in contact with the nip forming component 68.

Further, a TRIAC, which is a bidirectional Thyristor, begins to supply the ceramic heater 63 with electric power, in response to the print start signal. As electric current is flowed through the heat generating resistor 63*b* of the ceramic heater 63, it quickly generates heat, heating thereby the inward surface of the heating film 64. Consequently the heating film 64 heats the peripheral surface of the fixation roller 51.

The temperature of the ceramic heater 63 is detected by a thermistor 2, as a temperature detection element, with which the opposite surface of the substrate 63*a* from the heating-pressing nip Nk is provided. The controlling section 40 which is a controlling means takes in the temperature signals (output signals) from the thermistor 2. Then, it controls the TRIAC in the voltage which the TRIAC applies to the heat generating resistor 63*b*, in duty ratio, wave count, etc., so that the detected temperature of the ceramic heater 63 remains at a fixation level (target level).

While the fixation roller 51 is rotationally driven, and the temperature of the ceramic heater 63 is kept at the fixation level, a sheet P of recording medium on which an unfixed toner image t has just been formed, is introduced into the fixation nip N, in such an attitude that its surface bearing the unfixed toner image t faces toward the fixation roller 51.

Then, the sheet P is conveyed through the fixation nip N in the direction indicated by the arrow mark b in FIG. 2, by the combination of the fixation roller 51 which is rotating in the direction indicated by the arrow mark d in FIG. 2, and the pressure film 66 which is being rotated by the rotation of the fixation roller 51 in the direction indicated by the arrow mark e in FIG. 2, while remaining pinched between the fixation roller 51 and pressure film 66. While the sheet P is conveyed through the fixation nip N, the unfixed toner image t on the surface of the sheet P is thermally fixed to the surface of the sheet P by the combination of the heat from the fixation roller 51 which is being heated by the ceramic heater 63, and the pressure applied by the pressure film 66. After the fixation of the unfixed toner image t to the sheet P, the sheet P is discharged from the fixation nip N by the combination of the fixation roller 51 and pressure film 66.

<Nip Forming Component>

Next, referring to parts (a) and (b) of FIG. 4, the nip forming component 68 in this embodiment is described about its structure. Part (a) of FIG. 4 is a sectional view of the area of contact between the nip forming component 68 and pressure film 66 in this embodiment.

The nip forming component 68 presses the pressure film 66 toward the fixation roller 51 (upward in part (a) of FIG. 4) by being placed in contact with the inward surface of the pressure film 66. The nip forming component 68 has a substrative layer 68*b* (substrate) which functions as a heat transfer layer for making the nip forming component 68 uniform in temperature in terms of the lengthwise direction (left-right direction in FIG. 3). It has also a top layer 68*a* (low friction layer) on which the pressure film 66 slides by its inward surface. The top layer 68*a* is on the pressure film 66 side of the substrate 68*b*. Further, the nip forming component 68 has a back layer 68*c* which is on the guiding component 67 side of the substrate 68*b*. That is, the nip forming component 68 is made up of the three layers, more specifically, the top layer 68*a* (film pressing layer), substrative layer 68*b*, and back layer 68*c*.

As the material for the substrative layer 68*b* of the nip forming component 68, a substance which is high in thermal conductivity is used, in order to keep the nip forming component 68 uniform in temperature in terms of the lengthwise direction (left-right direction in FIG. 3). This function of the substrative layer 68*b* makes it possible for the nip forming component 68 to prevent the out-of-sheet-path portions of the fixation nip N from excessively increasing in temperature.

Further, the function enables the image forming apparatus 1 to continuously form images on a substantial number of small sheets P of recording medium at the same, or close to the same, level of productivity as that at which it can on a substantial number of larger sheets P of recording medium.

The nip forming component 68 can be increased in the efficiency with which it can keep itself uniform in temperature in terms of the lengthwise direction (left-right direction in FIG. 3) by increasing its substrative layer 68*b* in cross-sectional size. However, increasing the substrative layer 68*b* in cross-sectional size increases the nip forming component 68 in thermal capacity, making it difficult to make the fixation roller 51 quickly increase in temperature.

In other words, increasing the substrative layer 68*b* in cross-sectional dimension increases the length of time it takes for the fixation roller 51 to reach its fixation temperature level, in particular, FPOP (length of time it takes for the image forming apparatus 1 to output the first image in an image forming operation), which is a problematic.

Therefore, it is desired that a substance to be used as the material for the substrative layer 68*b* of the nip forming component 68 is as high as possible in thermal conductivity, and also, that it is formed of such a plate of thermally conductive substance, which is wide enough to provide the nip forming component 68 with a sufficient width for forming the fixation nip N.

Among metallic substances which are highly thermally conductive, aluminum is most suitable as the material for the substrative layer 68*b* of the nip forming component 68, because it is easy to work in terms of surface finish. Pure aluminum (substance which is no less than 99.0 wt. % in aluminum content) is roughly 235 W/m·K in thermal conductivity.

The thermal conductivity of the aluminum used as the material for the substrative layer 68*b* of the nip forming component 68 in this embodiment was obtained with the use of the following method. First, the material (aluminum) was measured in thermal diffusivity and specific heat with the use of a thermal property measuring device based on a laser flash method (LFA-502: product of Kyoto Electronic Manufacturing Co., Ltd.). Then, it was measured in density with the use of an electronic balance (highly precise densimeter: product of As One Co., Ltd.). Then, the thermal conductivity was obtained by calculation based on the measured thermal diffusivity and specific heat. By the way, there is a measurement error of □10% in the thermal conductivity of the material (aluminum) obtained based on the measured thermal diffusivity and specific weight.

In this embodiment, pure aluminum (A1050) which is no less than 99.0 wt. % in aluminum content was used as the material for the substrative layer 68*b* of the nip forming component 68. The nip forming component 68 was provided with the top layer 68*a* (film pressing layer on which pressure film 66 slide) and back layer 68*c*, which were formed by anodizing the top and bottom surfaces of the substrative layer 68*b*.

The nip forming component 68 is provided with the top layer 68*a* (film pressing layer), that is, a film (layer) of aluminum oxide formed by the anodization, as a friction-resistant layer, which contacts the inward surface of the pressure film 66. Further, the nip forming component 68 is provided with the back layer 68*c* which was formed by anodizing the opposite surface of the substrative layer 68*b* from the top layer 68*a* (film pressing layer).

Anodization means a process for forming a film of aluminum oxide ($Al_2O_3$: alumina) by electrochemically oxidizing the surface of a plate of aluminum with the use of electrolyte such as sulfuric acid and oxalic acid. The top layer 68*a* (film pressing layer), which is a layer of aluminum oxide, functions as a protective layer (resistant to frictional wear) for protecting the surface of the nip forming component 68.

The process for manufacturing the nip forming component 68 used in this embodiment is as follows. To begin with, a sheet of aluminum, which is the same in thickness as the nip forming component 68, and is greater in length and width than the nip forming component 68, is subjected to an anodizing process to form a layer of aluminum oxide on both surface of the sheet. Then, this anodized sheet of aluminum is subjected to a pressing process to yield the nip forming component 68. Thus, aluminum is exposed at peripheral surfaces (lateral surfaces) of the nip forming component 68, which resulted as the anodized sheet of aluminum is subjected to the pressing process. That is, with the use of the above-described processes, it is possible to yield the nip forming component 68, the top (front) and back layers 68*a* and 68*c*, respectively, of which is an aluminum oxide layer (low friction layer), and from the peripheral surfaces (surfaces which are vertical to top and bottom surfaces), in terms of both the recording medium conveyance direction and the lengthwise direction, which the substrative layer 68*b* remains exposed.

The nip forming component 68 was 10 mm in width in terms of the recording medium conveyance direction (left-right direction in FIG. 3), 0.8 mm in the thickness of the substrative layer 68*b*, and 15 μm in the thickness of its top layer 68*a* (low friction layer) and back layer 68*c*.

The top layer 68*a* (film pressing layer), substrative layer 68*b*, and back layer 68*c* of which the nip forming component 68 is made up are different in coefficient of thermal expansion (ratio by which substance thermally expands per unit amount of temperature). Shown in part (a) of FIG. 7 are the coefficient of thermal expansion of the aluminum oxide and that of pure aluminum. The values of the coefficient of thermal expansion shown in part (a) of FIG. 7 was borrowed from the data provided by URL <http://www.ognic.ne.jp/high.html> of OGIC Co., Ltd.

During an image forming operation (printing operation), the heat generated by the ceramic heater 63 with which the heating unit 52 is provided is transmitted to the pressure unit 53 through the heating film 64 and fixation roller 51, whereby the temperature of the pressure unit 53 is kept in a high range of 100° C.-150° C.

When the temperature of the pressure unit 53 is in the high range of 100° C.-150° C., the substrative layer 68*b* formed of aluminum is different in the amount of thermal expansion from the top layer 68*a* (film pressing layer) which is a film of aluminum oxide. Thus, the nip forming component 68 is subjected to such stress that works in the direction to deform the nip forming component 68. If the top layer 68*a* (film pressing layer) and back layer 68*c*, which are the front and back surfaces of the nip forming component 68, respectively, are different in the amount of thermal expansion, the nip forming component 68 warps.

In this embodiment, the back layer 68*c* of the nip forming component 68 is also a layer (film) of anodized aluminum. In other words, the top layer 68*a* (film pressing layer) and back layer 68*c* of the nip forming component 68, which are the front and rear layers, respectively, of the nip forming component 68, are the same in the amount of thermal expansion. Therefore, the nip forming component 68 does not warp; the nip forming component 68 is prevented from warping, by making the top layer 68*a* (film pressing layer) and back layer 68*c* the same in the amount of thermal expansion.

<Function of Nip Forming Component>

Next, referring to FIGS. 4 and 5, the functions of the nip forming component 68 in this embodiment are described. Part (b) of FIG. 4 is a sectional drawing for showing the structure of the nip forming component 68 of the fixing device 50 in this embodiment. Part (a) of FIG. 5 is a sectional view of the area of contact between the nip forming component 68 and the inward surface of the pressure film 66, in one of comparative fixing devices (50). Part (b) of FIG. 5 is a sectional view of the nip forming component 68, and its adjacencies, of the comparative fixing device 50 during a printing operation. It shows the structure of the nip forming component 68.

As described above with reference to part (a) of FIGS. 4 and 4(*b*), each of the top layer 68*a* (film pressing layer) and back layer 68*c*, which are the front and rear layers, respectively, of the nip forming component 68 of the fixing device 50 in this embodiment, is formed by anodizing the front and rear surfaces of the sheet of pure aluminum. That is, it is a layer of aluminum oxide. In other words, the nip forming component 68 is made up of three layers, more specifically, the substrative layer 68*b*, top layer 68*a* (film pressing layer) and back layer 68*c*.

The state in which the nip forming component 68 is during a printing operation in which it is kept high in temperature is as follows. The top layer 68*a* (film pressing layer) is smaller in the amount of thermal expansion than the substrative layer 68*b*. Therefore, the top layer 68*a* (film pressing layer) side of the substrative layer 68*b* is subjected to such a force that is generated by the tension of the top layer 68*a* (film pressing layer) and works in the direction to cause the nip forming component 68 to warp in such a manner that the nip forming component 68 concaves from the top layer 68*a* (film pressing layer) side (part (b) of FIG. 5).

Further, the back layer 68*c* of the nip forming component 68 is also smaller in the amount of thermal expansion than the substrative layer 68*b*. Thus, as the nip forming component 68 is heated, it is subjected to such a force that is generated by the tension of the back layer 68*c* and works in the direction to cause the nip forming component 68 to concave from the back layer 68*c* side (part (b) of FIG. 4).

In this embodiment, the top layer 68*a* (film pressing layer) and back layer 68*c* are roughly the same in the amount of thermal expansion. Therefore, the amount of force generated by the difference, in the amount of thermal expansion, between the top layer 68*a* (film pressing layer) and substrative layer 68*b*, in the direction to cause the nip forming component 68 to concave from the top layer 68*a* (film pressing layer) side, is the same as the amount of force generated by the difference, in the amount of thermal expansion, between the back layer 68*c* and substrative layer 68*b*, in the direction to cause the nip forming component 68 to concave from the back layer 68*c* side. That is, the two forces are the same in strength, and opposite in the direction in which they work to cause the nip forming component 68 to warp, and therefore, they cancel each other. Therefore, even when the nip forming component 68 is high in temperature, the top layer 68*a* (film pressing layer) (top surface in part (b) of FIG. 4) of the nip forming component 68 remains flat.

In a test in which the top layer 68*a* (film pressing layer) (top surface in part (b) of FIG. 4) of the nip forming component 68 in this embodiment was measured in flatness with the use of one of known flatness measuring devices revealed while the temperature of the nip forming component 68 was kept at 150° C., the surface (top surface in part (b) of FIG. 4) of the top layer 68*a* (film pressing layer) of the nip forming component 68 remained flat.

Thus, even when the temperature of the nip forming component 68 is kept at the fixation level, the fixation nip N remains flat as shown in part (b) of FIG. 4. Therefore, as a sheet P of recording medium is conveyed through the fixing device 50, it is discharged from the fixation nip N in the intended direction indicated by the arrow mark b (leftward in part (b) of FIG. 4).

Referring to part (a) of FIGS. 5 and 5(*b*), the nip forming component 68 of the comparative fixing device 50, it is made up of only two layers, that is, the substrative layer 68*b*, and the top layer 68*a* (film pressing layer) formed on the pressure film 66 side of the substrative layer 68*b* by anodizing the sheet of pure aluminum as the material for the nip forming component 68. The nip forming component 68 of the comparative fixing device 50 shown in part (a) of FIGS. 5 and 5(*b*) was 10 mm in width in terms of the recording medium conveyance direction (left-right direction in FIG. 6(*a*), 0.8 mm in the thickness of the substrative layer 68*b*, and 15 μm in the thickness of the top layer 68*a* (film pressing layer).

Part (b) of FIG. 5 is a sectional drawing which shows the state in which the nip forming component 68 of the comparative fixing device 50 is during a printing operation. Referring to part (b) of FIG. 5, during a printing operation in which the nip forming component 68 was kept high in temperature, the nip forming component 68 of the comparative fixing device 50 warped in such a manner that the nip forming component 68 concaved from the side of the top layer 68*a* (film pressing layer) which is smaller in the amount of thermal expansion than the substrative layer 68*b*.

When the surface (top surface in part (b) of FIG. 5) of the nip forming component 68 of the comparative fixing device 50 was measured in flatness with the use of one of known flatness measuring devices while the temperature of the nip forming component 68 was kept at 150□ C., both the upstream and downstream edges of the surface (top surface in part (b) of FIG. 5) of the top layer 68*a* (film pressing layer), in terms of the recording medium conveyance direction (left-right direction in part (b) of FIG. 5, were roughly 70 μm above the center of the surface.

Referring to part (b) of FIG. 5, as the nip forming component 68 downwardly concaves, the fixation nip N which is formed by the nip forming component 68 concaves in the manner to conform to the curvature of the peripheral surface of the fixation roller 51. Thus, a sheet P of recording medium is discharged from the fixation nip N in the sheet discharge direction c indicated by a broken line which is tilted toward the fixation roller 51 by an angle α relative to the intended recording medium conveyance direction b.

In the case of the comparative fixing device 50 shown in part (b) of FIG. 5, the direction in which a sheet P of recording medium is discharged from the fixation nip N is tilted by an angle θ toward the fixation roller 51. Therefore, as the sheet P is discharged from the fixation nip N, the toner image on the sheet P continues to be heated by the heat from the fixation roller 51, being therefore likely to remain adhered to the peripheral surface of the fixation roller 51, in the adjacencies of the recording medium outlet of the fixation nip N. If the toner image on the sheet P remains adhered to the peripheral surface of the fixation roller 51 as the sheet P is discharged from the fixation nip N, the sheet P is likely to wrap around the fixation roller 51, failing thereby to be properly conveyed.

<Comparison in Conveyance> part (b) of FIG. 7 shows the results of comparison between the fixing device 50 in this embodiment, and comparative fixing device 50, in terms of recording medium conveyance, which were obtained by conducting tests in which images were printed on sheets P of recording medium with the use of the image forming apparatus 1 equipped with the fixing device 50 in this embodiment shown in part (b) of FIG. 4, and the image forming apparatus 1 equipped with the comparative fixing device 50.

Referring to part (b) of FIG. 7, 5000 sheets P of recording medium, which did not have a toner image, were conveyed through the fixing device 50 in this embodiment shown in part (b) of FIG. 4, and the comparative fixing device 50 shown in part (b) of FIG. 5. In this case, neither of fixing devices 50 failed to properly convey the sheets P.

On the other hand, when 5000 sheets P of recording medium, on which a toner image was present, were conveyed through the fixing device 50 in this embodiment shown in part (b) of FIG. 4, and the comparative fixing device 50, the two fixing devices 50 were different in recording medium conveyance. That is, in the case of the comparative fixing device 50 shown in part (b) of FIG. 5, recording medium conveyance failure, which is attributable to the wrapping of a sheet P of recording medium around the fixation roller 51, occurred three times.

It is evident from part (b) of FIG. 7 that the nip forming component 68 of the fixing device 50 in this embodiment shown in part (b) of FIG. 5 is effective to prevent the occurrence of the recording medium conveyance error, which is attributable to the wrapping of a sheet P of recording medium around the peripheral surface of the fixation roller 51.

Referring to part (b) of FIG. 4, in the case of the nip forming component 68 in this embodiment, its upstream and downstream surfaces, in terms of the recording medium conveyance direction (left-right direction in part (b) of FIG. 4), are not anodized to form an oxide layer which is resistant to frictional wear. Next, referring to part (a) of FIGS. 6 and 6(*b*), the reason why the upstream and downstream surfaces of the nip forming component 68 are not anodized is described.

Part (a) of FIG. 6 is a perspective view of the combination of the guiding component 67 and nip forming component 68 in this embodiment. It shows the structure of the components 67 and 68. During a printing operation, the nip forming component 68 remains in contact with the inward surface of the pressure film 66 while the pressure film 66 is moved in the direction indicated by an arrow mark e in part (b) of FIG. 4 by the movement of the peripheral surface of the fixation roller 51 which rotates in the direction indicated by an arrow mark d in part (b) of FIG. 4.

Thus, the nip forming component 68 is subjected to a force F which presses the nip forming component 68 in the recording medium conveyance direction b. Thus, it is necessary to prevent the nip forming component 68 from being moved relative to the guiding component 67 by this force F. Referring to part (a) of FIG. 6, in this embodiment, therefore, the guiding component 67 is provided with a pair of protrusions 67*b* and 67*c*, which protrude upstream, in terms of the recording medium conveyance direction c, from the lengthwise ends of the downstream wall of the groove 67*a* (recess) of the guiding component 67, one for one, in order to control the nip forming component 68 in its position in terms of the recording medium conveyance direction (left-right direction in part (b) of FIG. 4).

Idealistically, the protrusions 67*b* and 67*c* shown in part (a) of FIG. 6 are the same in size. In consideration of the tolerance, in terms of measurement, allowed in the manufacturing of the guiding component 67, however, the protrusions 67*b* and 67*c* are sometimes different in size. In such cases, it is impossible to position the nip forming component 68 so that the nip forming component 68 becomes parallel to the groove 67*a* (recess) of the guiding component 67.

For the purpose of minimizing the effect of the tolerance, in terms of measurement, afforded to the projections 67*b* and 67*c*, it is desired that the protrusions 67*b* and 67*c* are positioned so that their distance in terms of the lengthwise direction of the groove 67*a* (recess) becomes as large as possible. In this embodiment, therefore, only the lengthwise ends of the downstream wall of the groove 67*a* (recess) of the guiding component 67 are provided with the protrusions 67*b* and 67*b*, one for one.

There is not provided an additional protrusion between the protrusions 67*b* and 67*c* with which the lengthwise ends of the groove 67*a* (recess) of the guiding component 67 in terms of the lengthwise direction are provided. However, in consideration of the tolerance, in terms of measurement, afforded to the protrusions 67*b* and 67*c*, it is acceptable to provide the guiding component 67 with an unshown protrusion which is placed between the protrusions 67*b* and 67*c* with which the lengthwise ends, one for one, of the groove 67*a* (recess) of the guiding component 67 is provided, and which does not come into contact with the nip forming component 68.

Part (b) of FIG. 6 is a perspective drawing of the combination of the nip forming component 68 and guiding component 67 of the fixing device 50 in this embodiment. It is for describing the state of the combination after the image forming apparatus 1 equipped with the fixing device 50 in this embodiment was continuously used to print images on a substantial number of sheets P of recording medium.

While the image forming apparatus 1 equipped with the fixing device 50 in this embodiment is continuously used to form images on a substantial number of sheets P of recording medium, the pressure film 66 is continuously rotated in the direction indicated by the arrow mark e in part (b) of FIG. 4, sliding on the nip forming component 68. Thus, the nip forming component 68 is continuously subjected to a force generated in the direction parallel to the recording medium conveyance direction b by the friction which occurs between the nip forming component 68 and the inward surface of the pressure film 66. Thus, the center portion of the nip forming component 68, in terms of the lengthwise direction, which are not regulated by the protrusions 67*b* and 67*c* bends in the recording medium conveyance direction b as if the nip forming component 68 bows in the recoding medium conveyance direction b, as shown in part (b) of FIG. 6.

The entire surfaces of the nip forming component 68, including the end surfaces 68*d* and 68*e* in terms of the recoding medium conveyance direction b (left-right direction in part (b) of FIG. 4), are covered with aluminum oxide film (aluminum oxide layer) formed by anodization. During a process of anodizing the surfaces of the nip forming component 68, electric current concentrates to the ends of the nip forming component 68. Thus, the so-called "burn" sometimes occurs to the ends of the nip forming component 68; it sometimes occurs that the ends of the nip forming component 68 end up being imperfectly covered with aluminum oxide film. The end surfaces of the nip forming component 68, which suffer from "burn" are lower in hardness, and also, lower in the resistance to frictional wear than the normal film of aluminum oxide.

Therefore, if the entire surfaces of the nip forming component 68 (substrative layer 68*b*) are covered with aluminum oxide film (aluminum oxide layer) by anodization, the nip forming component 68 bends in such a manner that the center portion of the nip forming component 68, in terms of the lengthwise direction, bows downstream in terms of the recording medium conveyance direction b, as shown in part (b) of FIG. 6. As the nip forming component 68 bows downstream, the downstream surface 68*e* of the nip forming component 68 in terms of the recording medium conveyance direction b is subjected to tensional stress, whereas the upstream surface 68*d* of the nip forming component 68 in terms of the recording medium conveyance direction b is subjected to compressional stress.

These stresses sometimes cause the aluminum oxide film formed on the upstream and downstream surfaces of the nip forming component 68 in terms of the recording medium conveyance direction b to peel away in pieces. As the aluminum oxide film peels away in pieces, some pieces sometimes enters the area of contact between the top surface of the film pressing layer 68*a* of the nip forming component 68, and the inward surface of the pressure film 66, causing thereby the inward surface of the pressure film 66 to significantly wear, which in turn causes the image forming apparatus 1 to output defective images.

Thus, in order to prevent the image forming apparatus 1 from outputting defective images attributable to the peeling of the aluminum oxide film formed on the upstream and downstream surfaces of the nip forming component 68 in terms of the recoding medium conveyance direction b, it is necessary to prevent aluminum oxide film from peeling from the upstream and downstream ends of the nip forming component 68. In this embodiment, therefore, aluminum oxide film (aluminum oxide layer), which functions as a layer resistant to frictional wear, is not formed on the upstream and downstream end surfaces 68*d* and 68*e* in terms of the recording medium conveyance direction b; the substrative layer 68*b* is left exposed. By the way, it may be not only on the end surfaces 68*d* and 68*e* of the nip forming component 68, but also, the peripheral surfaces of the nip forming component 68 (surfaces which are perpendicular to the surface 68*a* which faces pressure film 66), that aluminum oxide film is not formed.

In this embodiment, only the top and bottom surfaces of the nip forming component 68 were anodized to provide the top and bottom sides of the nip forming component 68 with oxides layers (films) 68*a* and 68*c*, respectively. On the other hand, the upstream and downstream end surfaces 68*d* and 68*e* in terms of the recording medium conveyance direction e were not anodized to create an oxide film.

According to this embodiment, it does not occur that the image forming apparatus 1 outputs defective images, the defects of which are attributable to the problem that the oxide film (oxide layer) formed on the surfaces of the nip forming component 68 by anodization peels away from the substrative layer 68*b*. Moreover, it is possible to provide a fixing device 50 (heating device) which does not suffer from the problem that a sheet P of recording medium is caused to wrap around the fixation roller 51 by such warping of the nip forming component 68 that occurs to the nip forming component 68 of the comparative fixing device 50 shown in part (b) of FIG. 5.

Embodiment 2

Next, referring to FIGS. 8 and 9, the image forming apparatus, in the second embodiment of the present invention, equipped with a heating device which is in accordance with the present invention, is described about its structure. By the way, the structural components of the image forming apparatus 1 and its heating device, which are the same in structure as the counterparts in the first embodiment are given the same referential codes as those given to the counterparts, and are not described here.

In the first embodiment, it was pure aluminum that was used as the material for the substrative layer 68*b* of the nip forming component 68. Further, in order to ensure that the inward surface of the pressure film 66 smoothly slides on the nip forming component 68, the surface of the substrative layer 68*b*, which faces the inward surface of the pressure film 66, was anodized to form oxide film (oxide layer) to provide the nip forming component 68 with the top layer 68*a* which is resistant to frictional wear.

In this embodiment, copper was used as the material for the substrative layer 68*b* of the nip forming component 68. Further, glass is used as the material for the top layer 68*a* (pressure film pressing layer) which is resistant to frictional wear and covers the surface of the substrative layer 68*b*, which faces the inward surface of the pressure film 66, and the bottom layer 68*c* which is also resistant to frictional wear and is on the bottom surface of the substrative layer 68*b* of the nip forming component 68.

Otherwise, the nip forming component 68 in the second embodiment is the same in structure and function as the nip forming component 68 in the first embodiment. Thus, only the differences of the nip forming component 68 in this embodiment from the nip forming component 68 in the first embodiment are described here, in order not to repeat the same descriptions as those about the first embodiment.

FIG. 8 is a sectional view of the pressure unit 53 of the fixing device 50 in this embodiment. In the first embodiment, pure aluminum was used as the material for the substrative layer 68*b* of the nip forming component 68. In comparison, in this embodiment, copper was used as the material for the substrative layer 68*b* of the nip forming component 68. The thermal conductivity of copper is roughly 400 W/m·K, which is higher than the thermal conductivity of pure aluminum (roughly 235 W/m·K). Thus, the nip forming component 68 in this embodiment is more effective than the nip forming component 68 in the first embodiment, to prevent the out-of-sheet-path sections of the fixing device 50 from excessively increasing in temperature.

Also in this embodiment, the nip forming component 68 is provided with a glass layer as the top layer 68*a* (pressure film pressing layer) which faces the inward surface of the pressure film 66 to ensure that the pressure film 66 easily slides on the nip forming component 68. In this embodiment, a glass layer is formed, as the top layer 68*a*, on the substrative layer 68*b* to ensure that the pressure film 66 easily slides on the nip forming component 68.

Copper, which is used as the material for the substrative layer 68*b* of the nip forming component 68 in this embodiment is different in coefficient of thermal expansion from the glass used as the material for the top layer 68*a* for the nip forming component 68 in this embodiment. FIG. 9 shows the coefficient of copper and that of glass. Thus, if only the top surface of the substrative layer 68*b*, which faces the inward surface of the pressure film 66, is coated with a glass layer as the top layer 68*a*, as only the top surface of the substrative layer 68*b* of the comparative fixing device 50 was covered with an oxide layer, the nip forming component 68 warps during a printing operation, and creates the problem that a sheet P of recording medium wraps around the peripheral surface of the fixation roller 51.

In this embodiment, therefore, not only is the surface of the substrative layer 68*b* of the nip forming component 68, which faces the inward surface of the pressure film 66, covered with a layer of glass, on which the pressure film 66 slides, but also, the surface of the substrative layer 68*b*, which faces the guiding component 67 is coated with a glass layer as the bottom layer 68*c*.

Thus, during the thermal expansion of the nip forming component 68, the oxide layers 68*a* and 68*c*, which are the front and back layers, respectively, of the nip forming component 68, are the same in the amount of tensional stress. Therefore, unlike the nip forming component 68 of the comparative fixing device 50 shown in part (b) of FIG. 5, the nip forming component 68 in this embodiment does not warp during its thermal expansion.

Moreover, in this embodiment, copper which is higher in thermal conductivity than pure aluminum which was used as the material for the substrative layer 68*b* of the nip forming component 68 of the fixing device 50 in the first embodiment, was used as the material for the substrative layer 68*b* of the nip forming component 68 of the fixing device 50. Therefore, this embodiment can more effectively prevent the out-of-sheet-path portions of the fixing device 50 from excessively increase in temperature, than the first embodiment.

Further, in this embodiment, the surface of the substrative layer 68*b* of the nip forming component 68, which faces the inward surface of the pressure film 66, is coated with a glass layer 68*a*, on which the pressure film 66 slides, and the surface of the substrative layer 68*b*, which faces the guiding component 67, is coated with a glass layer 68*c*. Therefore, it is possible to prevent the nip forming component 68 from warping. Therefore, it is possible to prevent a sheet P of recording medium from wrapping around the peripheral surface of the fixation roller 51. Otherwise, the fixing device 50 in this embodiment is the same in structure as the fixing device 50 in the first embodiment, and can provide the same effects as the first embodiment.

Embodiment 3

The first and second embodiments were related to a fixing device, the fixation roller 51 of which is externally heated. However, these embodiments are not intended to limit the present invention in scope in terms of the type of fixing device to which the present invention is applicable. That is, the present invention is applicable to a fixing device such as the one in the third embodiment, which has: a cylindrical film 640; a nip forming component 680, which is in the form of a rectangular plate, and contacts the inward surface of the film 640; and a pressure roller 660 which forms a nip N in coordination with the nip forming component 680, as shown in part (a) of FIG. 10. Further, the fixing device 50 in this embodiment has: a supporting component 650 which supports the nip forming component 680 and guides the film 640; and a heater 630 which heats at least one of the inward surface of the nip forming component 680 and the inward surface of the film 640 with radiant heat.

The nip forming component 680 has: a substrate 680*a* formed of aluminum; and a pair of oxides film 680*b* (formed by anodizing the top and bottom surfaces of a plate of aluminum as the material for the substrate 680) which cover the surface (first surface) of the substrate 680*a*, which faces the film 640, and the opposite surface (second surface) of the substrate 680*a* from the first surface, one for one, as shown in part (b) of FIG. 10. The peripheral surfaces of the nip forming component 680 (surfaces which are perpendicular to first surface) have an area which is not covered with the oxide film 680*b*. Since the nip forming component 680 in this embodiment is structured as described above, it has the same effects as the nip forming component 68 in the first embodiment.

By the way, the material for the substrate 680*a* is aluminum. However, it does not need to be aluminum. All that is necessary is that the nip forming component 680 is structured so that the coefficient of thermal expansion of its surface layer 680*b* is smaller than the coefficient of thermal expansion of its substrate 680*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-104267 filed on May 22, 2015, which is hereby incorporated by reference herein in its entirety.

What is claimed is:

1. An image heating apparatus for heating a toner image on a recording material, said apparatus comprising:

a cylindrical film;

a plate-like nip forming member contacted with an inner surface of said film, said nip forming member including a base member and a coating layer on said base member, said coating layer having a thermal expansion coefficient smaller than that of said base member; and a roller cooperative with said nip forming member to form a nip, wherein said nip forming member includes a first surface contacting said film, a second surface opposite to the first surface, and a peripheral surface perpendicular to the first surface, and wherein said coating layer is provided on the first and second surfaces of said nip forming member, and is not provided on the peripheral surface of said nip forming member.

2. The image heating apparatus according to claim 1, further comprising a heating member configured to heat said roller, wherein the heat is effective to fix the toner image on the recording material.

3. The image heating apparatus according to claim 1, further comprising a heater configured to heat the inner surface of said film with radiant heat, wherein said heater is enclosed by said film.

4. An image heating apparatus for heating a toner image on a recording material, said apparatus comprising:

a cylindrical film;

a plate-like nip forming member contacted with an inner surface of said film, said nip forming member including a base member of aluminum and an oxide coating layer on said base member; and a roller cooperative with said nip forming member to form a nip, wherein said nip forming member includes a first surface contacting said film, a second surface opposite to the first surface, and a peripheral surface perpendicular to the first surface, and wherein said oxide coating layer is provided on the first and second surfaces of said nip forming member, and is not provided on the peripheral surface of said nip forming member.

5. The image heating apparatus according to claim 4, further comprising a heating member configured to heat said roller, wherein the heat is effective to fix the toner image on the recording material.

6. The image heating apparatus according to claim 4, further comprising a heater configured to heat the inner surface of said film with radiant heat, wherein said heater is enclosed by said film.

7. An image heating apparatus for heating a toner image on a recording material, said apparatus comprising:

a cylindrical film;

a plate-like nip forming member contacted with an inner surface of said film, said nip forming member including a base member and a coating layer on said base member, said coating layer having a thermal expansion coefficient smaller than that of said base member; and a roller cooperative with said nip forming member to form a nip, wherein said nip forming member includes a first surface contacting said film, a second surface opposite to the first surface, and a thickness surface, and wherein said coating layer is provided on the first and second surfaces of said nip forming member, and is not provided on the thickness surface of said nip forming member.

8. An image heating apparatus for heating a toner image on a recording material, said apparatus comprising:

a cylindrical film;

a plate-like nip forming member contacted with an inner surface of said film, said nip forming member including a base member of aluminum and an oxide coating layer on said base member; and a roller cooperative with said nip forming member to form a nip, wherein said nip forming member includes a first surface contacting said film, a second surface opposite to the first surface, and a thickness surface, and wherein said oxide coating layer is provided on the first and second surfaces of said nip forming member, and is not provided on the thickness surface of said nip forming member.

* * * * *